US011024983B2

(12) United States Patent
Onuma

(10) Patent No.: US 11,024,983 B2
(45) **Date of Patent: *Jun. 1, 2021**

(54) TERMINAL-EQUIPPED ELECTRIC WIRE

(71) Applicant: Yazaki Corporation, Tokyo (JP)

(72) Inventor: Masanori Onuma, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/852,333

(22) Filed: Apr. 17, 2020

(65) Prior Publication Data

US 2020/0373683 A1 Nov. 26, 2020

(30) Foreign Application Priority Data

May 21, 2019 (JP) ..... JP2019-095021

(51) Int. Cl.

| | |
|---|---|
| ***H01R 4/10*** | (2006.01) |
| ***H01R 4/18*** | (2006.01) |
| ***H01R 4/58*** | (2006.01) |
| ***H01R 13/52*** | (2006.01) |
| ***H01R 11/11*** | (2006.01) |
| ***H01R 43/048*** | (2006.01) |
| ***H01R 43/20*** | (2006.01) |

(52) U.S. Cl.

CPC ..... *H01R 4/184* (2013.01); *H01R 4/58* (2013.01); *H01R 11/11* (2013.01); *H01R 13/52* (2013.01); *H01R 43/048* (2013.01); *H01R 43/20* (2013.01)

(58) Field of Classification Search

CPC ..... H01R 4/184; H01R 4/183; H01R 4/18; H01R 4/04; H01R 4/02; H01R 4/58; H01R 11/11; H01R 13/52; H01R 13/46; H01R 13/048; H01R 13/20

See application file for complete search history.

(56) References Cited

U.S. PATENT DOCUMENTS

| | | | | |
|---|---|---|---|---|
| 8,622,775 | B2 * | 1/2014 | Takashima | H01R 4/185 439/886 |
| 9,083,100 | B2 * | 7/2015 | Uno | H01R 43/24 |
| 9,543,689 | B2 * | 1/2017 | Sato | H01R 4/188 |
| 9,640,933 | B2 * | 5/2017 | Kawamura | H01R 4/183 |

(Continued)

FOREIGN PATENT DOCUMENTS

| | | |
|---|---|---|
| JP | 2011-113708 A | 6/2011 |
| JP | 2015-41404 A | 3/2015 |
| JP | 2016-181387 A | 10/2016 |

*Primary Examiner* — Harshad C Patel

(74) *Attorney, Agent, or Firm* — Kenealy Vaidya LLP

(57) ABSTRACT

A terminal-equipped electric wire includes an electric wire having a core wire and a covering, a crimp terminal including a core wire crimp portion and a covering crimp portion, and a resin that integrally covers a range from a tip of the core wire to side surfaces of the covering crimp portion and that shields the core wire from an external space. The covering crimp portion has each of the bottom wall portion, the first crimping piece, and the second crimping piece coming in close contact with the covering, and the covering crimp portion is crimped to the covering with the first crimping piece laid over a tip portion of the second crimping piece. The resin closes a gap surrounded by the tip surface of the second crimping piece, an inner surface of the first crimping piece, and an outer surface of the covering.

6 Claims, 9 Drawing Sheets

(56) References Cited

U.S. PATENT DOCUMENTS 9,663,863 B2 * 5/2017 Takata ..... H01B 7/28
9,748,724 B2 * 8/2017 Sato ..... H01R 43/24
10,186,795 B2 * 1/2019 Ikeya ..... H01B 1/02
10,361,492 B1 * 7/2019 Yamashita ..... H01R 4/70
10,615,517 B2 * 4/2020 Onuma ..... H01R 13/52
10,854,353 B2 * 12/2020 Yamashita ..... B60R 16/00
2011/0070770 A1 3/2011 Sakai
2012/0202394 A1 * 8/2012 Uchiyama ..... H01R 4/184
439/877
2012/0329341 A1 * 12/2012 Morikawa ..... H01R 13/114
439/866
2013/0126234 A1 * 5/2013 Ono ..... H02G 15/08
174/75 R
2013/0213709 A1 * 8/2013 Kawamura ..... H01R 4/183
174/72 A
2013/0252481 A1 * 9/2013 Sato ..... H01R 43/005
439/736
2014/0335741 A1 * 11/2014 Uno ..... H01R 4/70
439/736
2014/0349501 A1 * 11/2014 Aizawa ..... H01R 13/5221
439/190
2015/0011117 A1 * 1/2015 Ohnuma ..... H01R 4/184
439/520
2015/0140202 A1 * 5/2015 Sato ..... H01R 43/005
427/58
2015/0140874 A1 * 5/2015 Sakaguchi ..... H01R 4/185
439/879
2016/0308301 A1 * 10/2016 Mano ..... H01R 13/5216
2017/0085012 A1 * 3/2017 Kayama ..... H01R 13/533
2018/0109088 A1 * 4/2018 Takayanagi ..... H01R 4/188
2018/0375275 A1 * 12/2018 Onuma ..... H01R 4/185
2018/0375276 A1 * 12/2018 Onuma ..... H01R 43/005
2019/0229437 A1 * 7/2019 Onuma ..... C22C 21/00
2020/0335926 A1 * 10/2020 Takeda ..... H01R 4/70
2020/0373684 A1 * 11/2020 Onuma ..... H01B 13/323
2020/0373685 A1 * 11/2020 Onuma ..... H01R 4/185

* cited by examiner

TERMINAL-EQUIPPED ELECTRIC WIRE

CROSS-REFERENCE TO RELATED APPLICATION(S)

The present application claims priority to and incorporates by reference the entire contents of Japanese Patent Application No. 2019-095021 filed in Japan on May 21, 2019.

BACKGROUND OF THE INVENTION

1. Field of the Invention

The present invention relates to a terminal-equipped electric wire.

2. Description of the Related Art

Conventionally, there have been techniques for applying a resin to a terminal-equipped electric wire as disclosed in Japanese Patent Application Laid-open No. 2016-181387 and Japanese Patent Application Laid-open No. 2015-41404, Japanese Patent Application Laid-open No. 2016-181387 discloses a terminal-equipped electric wire including a covered electric wire, a terminal including a conductor crimp portion and a covering crimp portion, and an ultraviolet-curable resin member covering the conductor exposed from an insulating covering. In the terminal-equipped electric wire of Japanese Patent Application Laid-open No. 2016-181387, the whole of the conductor crimping portion and the covering crimp portion is covered with a resin member.

Here, applying a resin to the covering crimp portion might cause an increase in the terminal height.

SUMMARY OF THE INVENTION

An object of the present invention is to provide a terminal-equipped electric wire capable of improving the anticorrosion performance while suppressing the terminal height.

In order to achieve the above mentioned object, a terminal-equipped electric wire according to one aspect of the present invention includes an electric wire having a core wire and a covering that exposes an end portion of the core wire and covers the core wire; a crimp terminal having a core wire crimp portion crimped to the core wire, and a covering crimp portion crimped to the covering; and a resin that integrally covers a range from a tip of the core wire to a side surface of the covering crimp portion and that shields the core wire from an external space, wherein the covering crimp portion includes a bottom wall portion, a first crimping piece extending from one end of the bottom wall portion in a width direction, and a second crimping piece extending from another end of the bottom wall portion in the width direction, the covering crimp portion has a configuration in which each of the bottom wall portion, the first crimping piece, and the second crimping piece is in close contact with the covering, and the covering crimp portion is crimped to the covering with the first crimping piece laid over a tip portion of the second crimping piece, and the resin closes a gap surrounded by a tip surface of the second crimping piece, an inner surface of the first crimping piece, and an outer surface of the covering, from the core wire crimp portion side.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a terminal-equipped electric wire according to an embodiment of the present invention will be described in detail with reference to the drawings. Note that the present invention is not limited by the embodiment. Moreover, components in the following embodiment include those that can be easily assumed by those skilled in the art or substantially identical.

Embodiment

Figure 1:
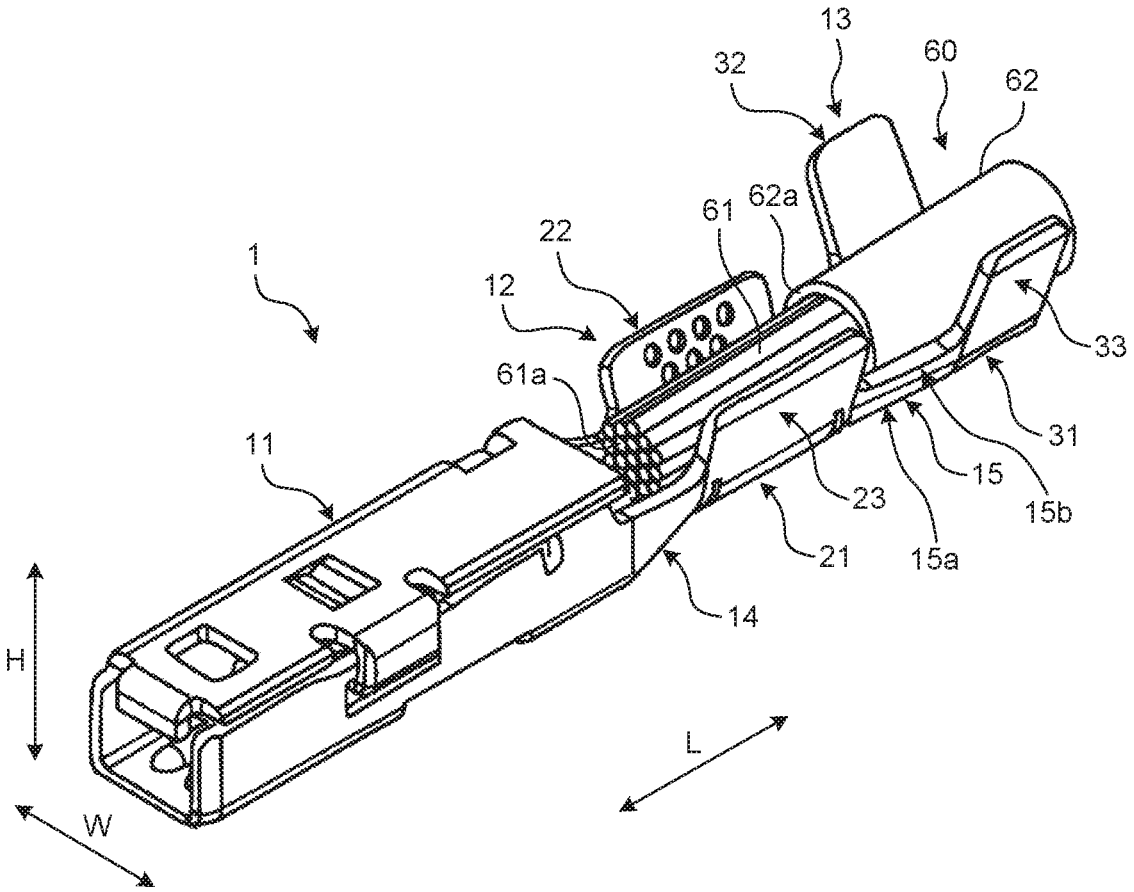
FIG. 1 is a perspective view illustrating a crimp terminal and an electric wire of an embodiment.
Figure 2:
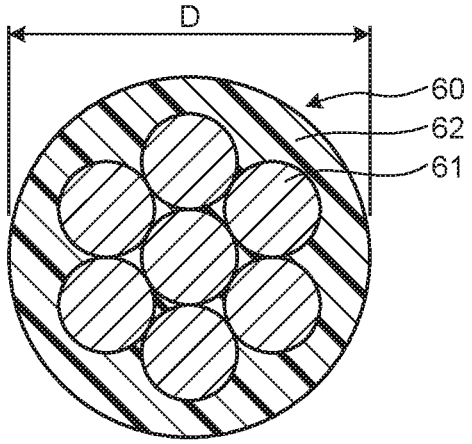
FIG. 2 is a cross-sectional view of an electric wire according to an embodiment.
Figure 3:
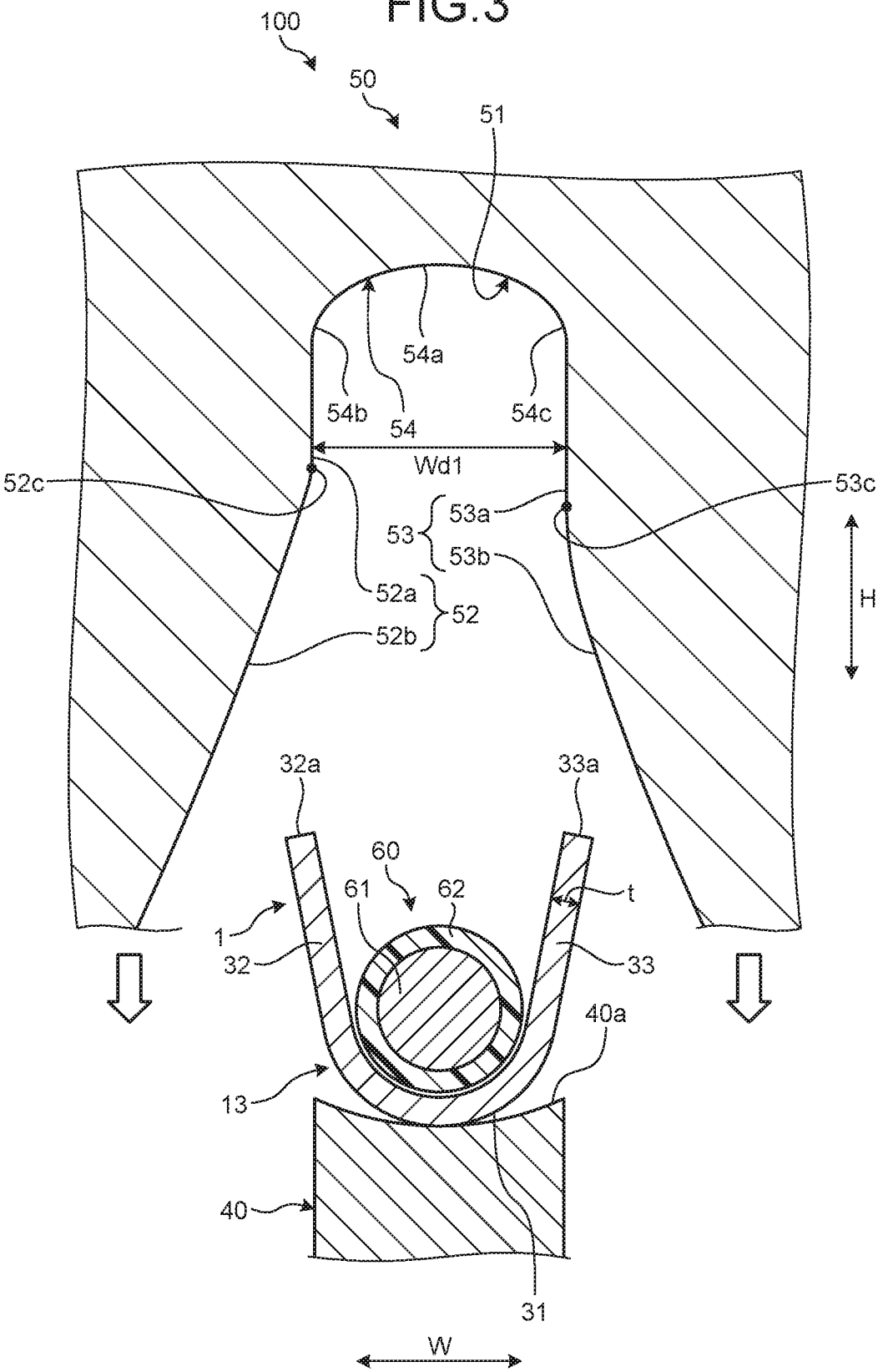
FIG. 3 is a cross-sectional view of a terminal crimping device according to an embodiment.
Figure 4:
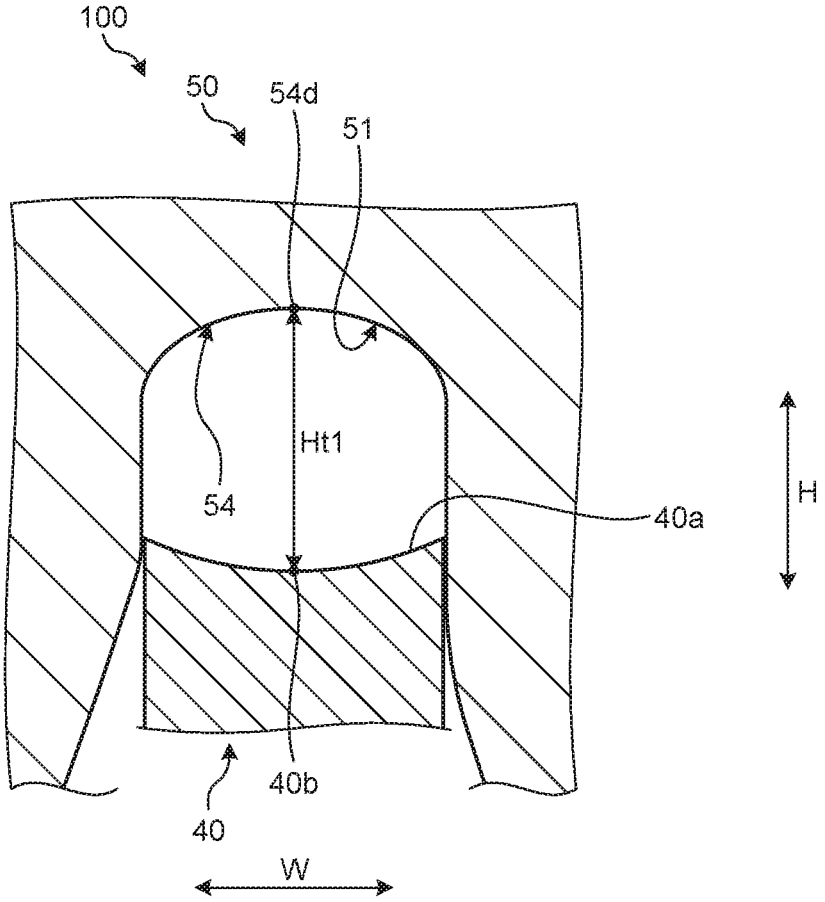
FIG. 4 is a front view of a terminal crimping device of an embodiment when an upper mold is at a bottom dead center.
Figure 5:
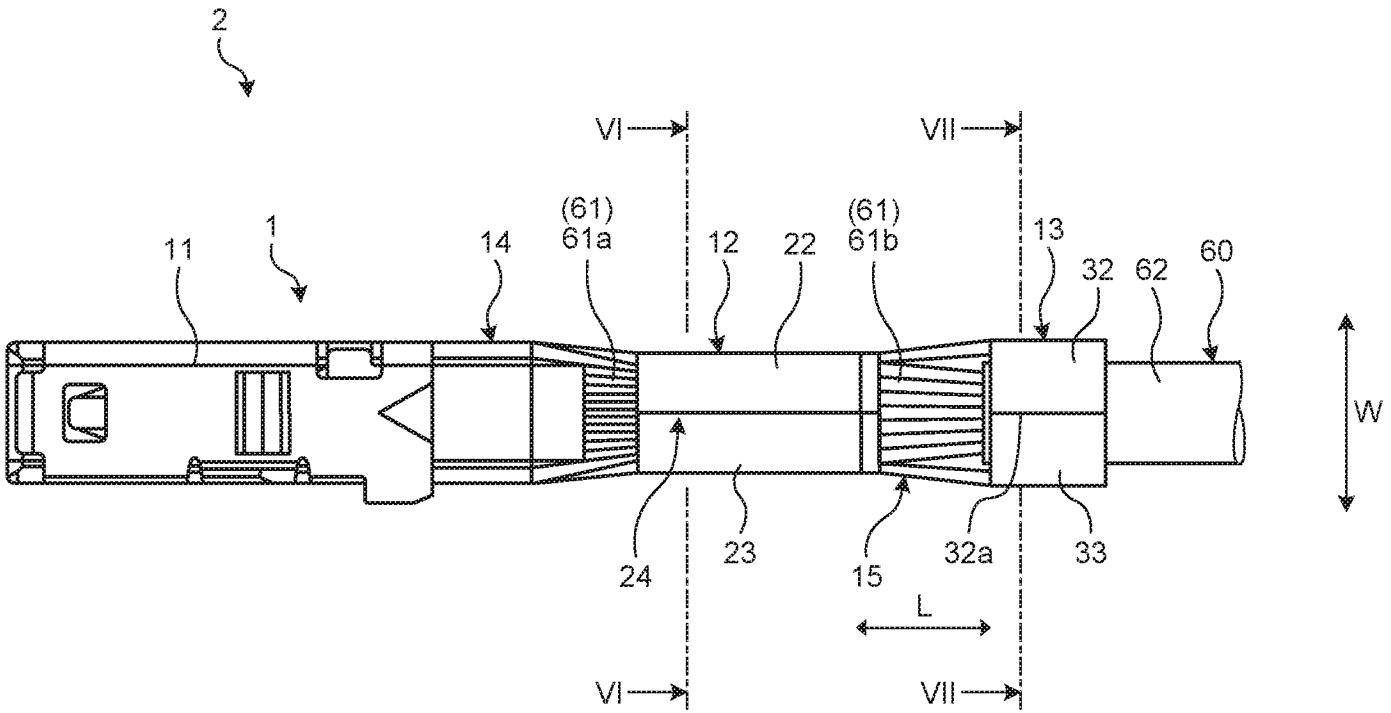
FIG. 5 is a plan view of a terminal-equipped electric wire according to an embodiment before a resin is applied.
Figure 6:
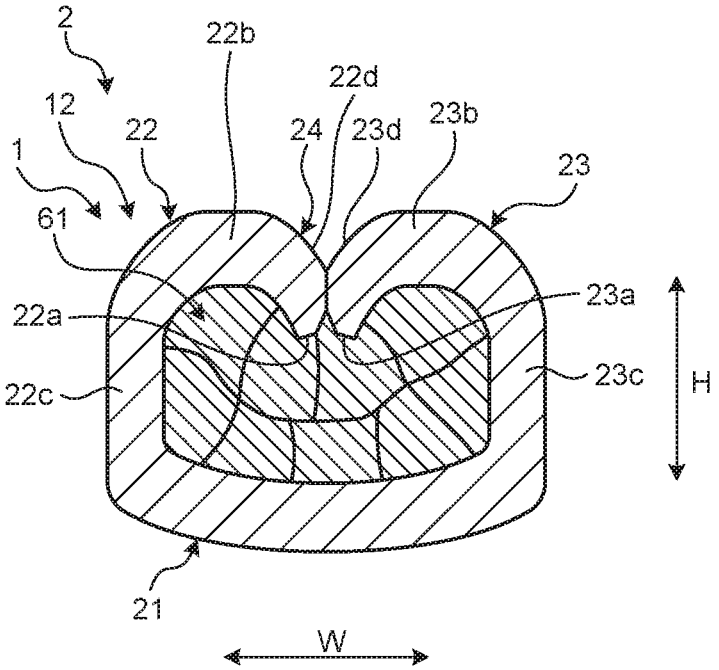
FIG. 6 is a cross-sectional view of a core wire crimp portion of a terminal-equipped electric wire according to an embodiment.
Figure 7:
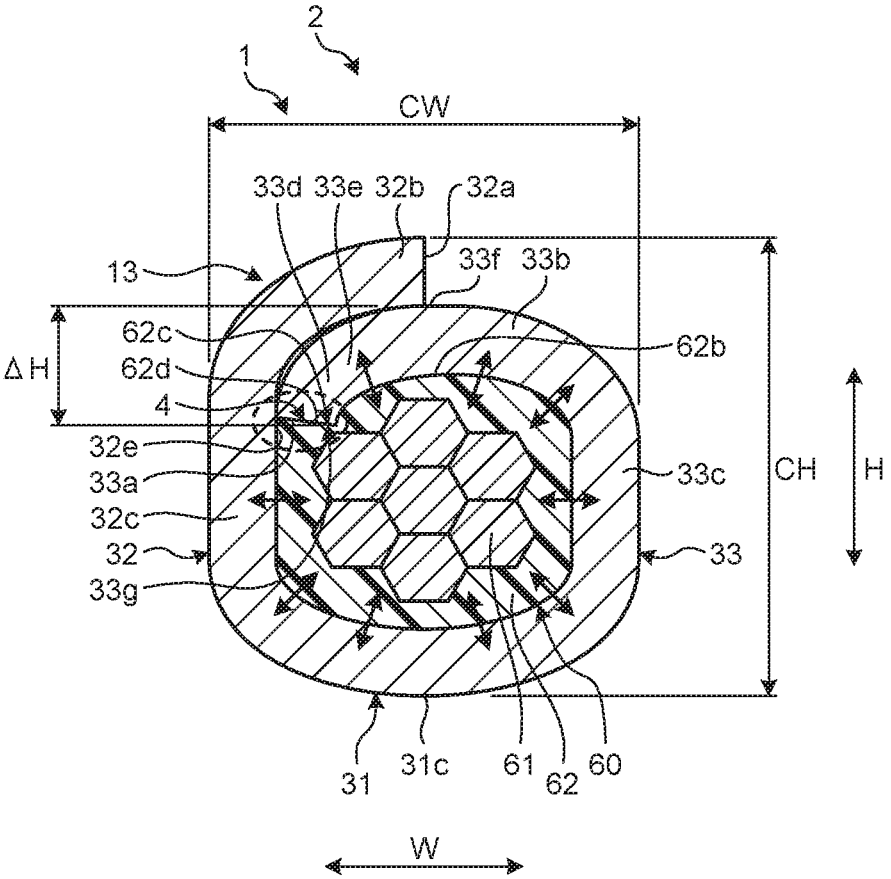
FIG. 7 is a cross-sectional view of a covering crimp portion of a terminal-equipped electric wire according to an embodiment.
Figure 8:
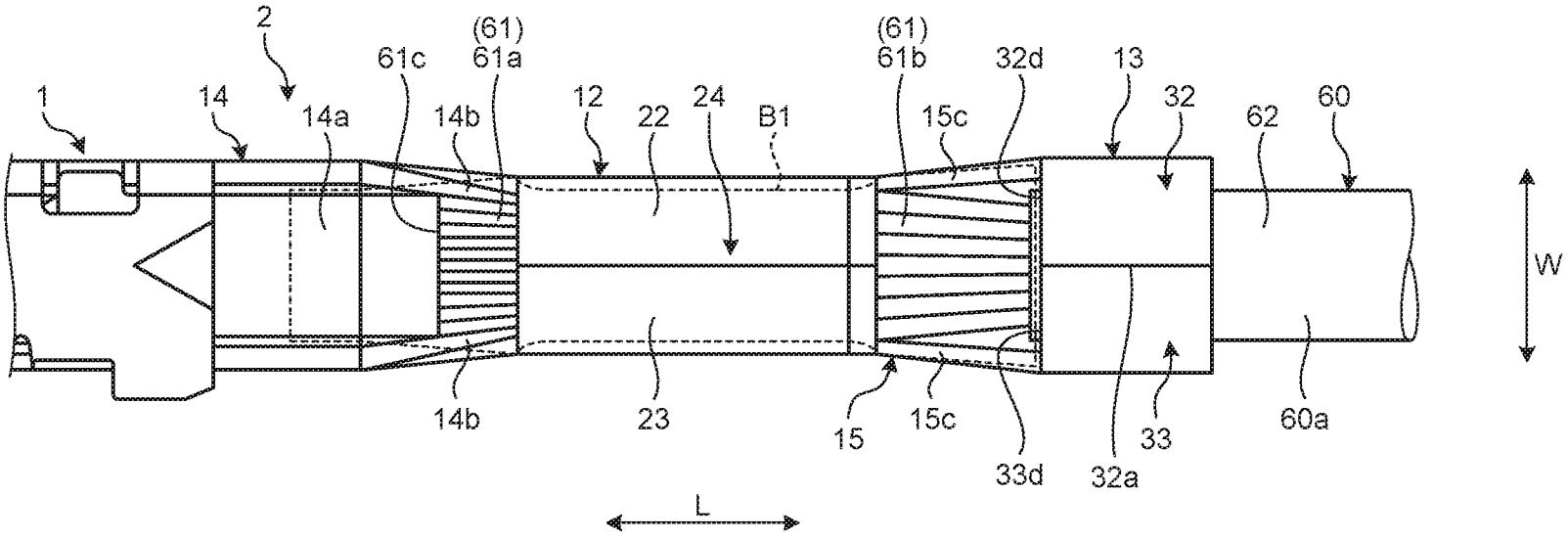
FIG. 8 is a plan view illustrating a resin application range of an embodiment.
Figure 9:
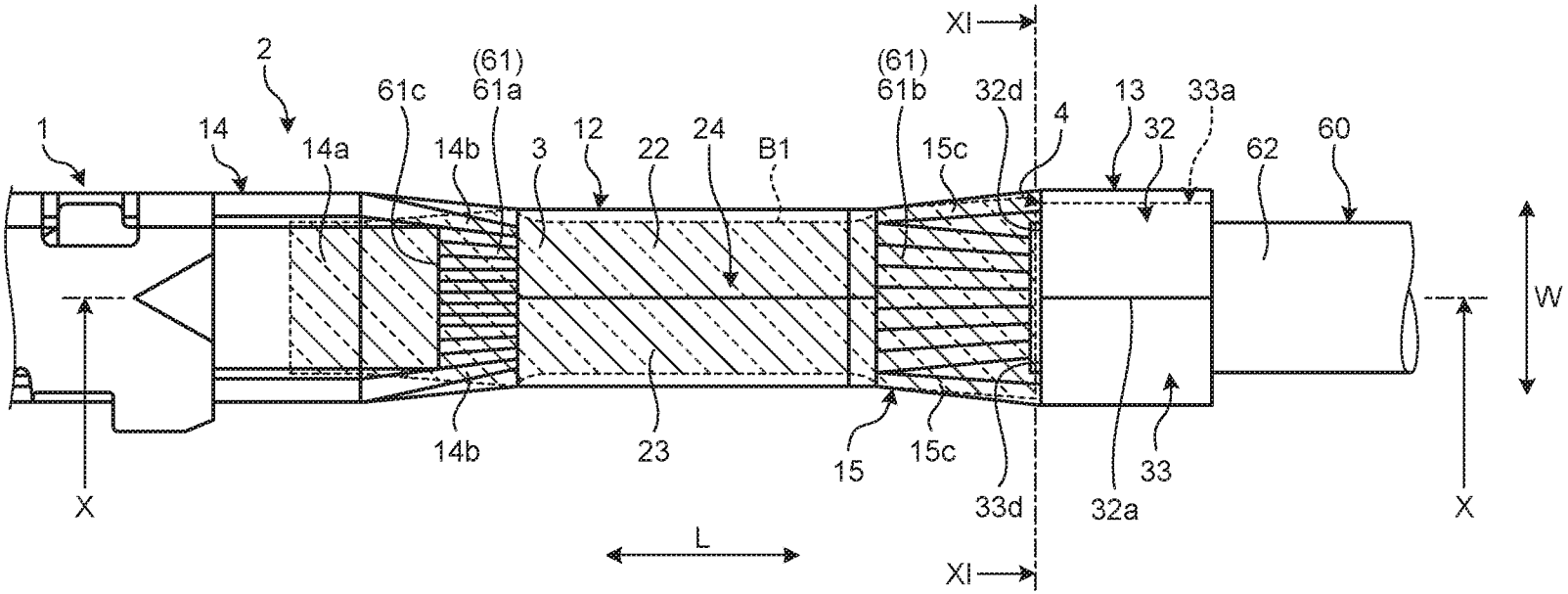
FIG. 9 is a plan view of a terminal-equipped electric wire according to an embodiment.
Figure 10:
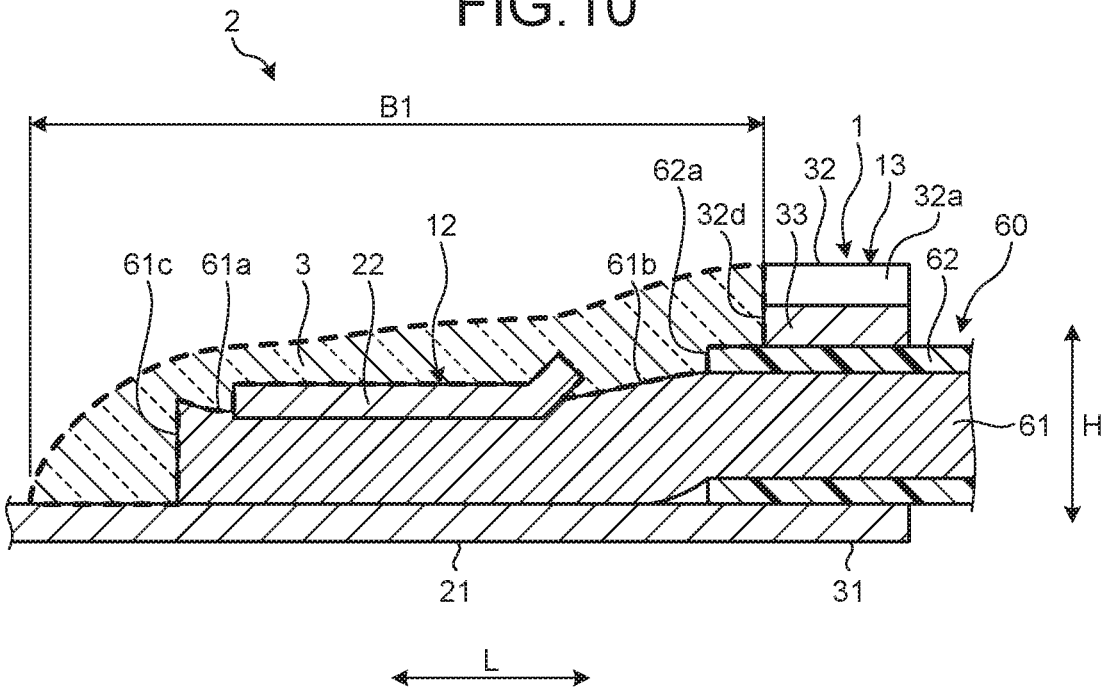
FIG. 10 is a longitudinal cross-sectional view of a terminal-equipped electric wire according to an embodiment.
Figure 11:
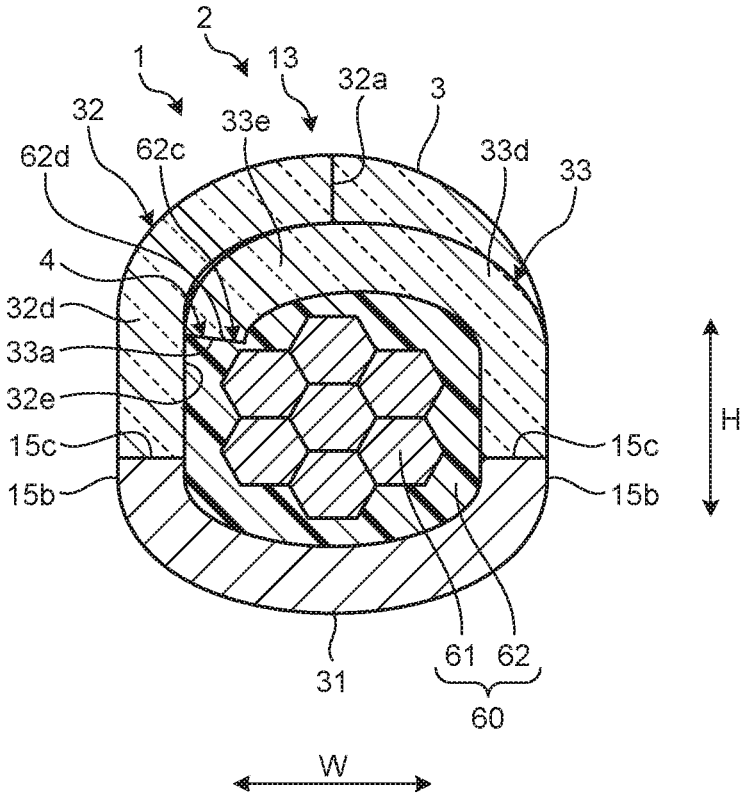
FIG. 11 is a lateral cross-sectional view of a terminal-equipped electric wire according to an embodiment.

An embodiment will be described with reference to FIGS. 1 to 12. The present embodiment relates to a terminal-equipped electric wire. FIG. 1 is a perspective view illustrating a crimp terminal and an electric wire of the embodiment. FIG. 2 is a cross-sectional view of the electric wire according to the embodiment. FIG. 3 is a cross-sectional view of a terminal crimping device according to the embodiment. FIG. 4 is a front view of the terminal crimping device of the embodiment when an upper mold is at the bottom dead center. FIG. 5 is a plan view of the terminal-equipped electric wire according to the embodiment before resin is applied. FIG. 6 is a cross-sectional view of a core wire crimp portion of the terminal-equipped electric wire according to the embodiment. FIG. 7 is a cross-sectional view of a covering crimp portion of the terminal-equipped electric wire according to the embodiment. FIG. 8 is a plan view illustrating a resin application range of the embodiment. FIG. 9 is a plan view of the terminal-equipped electric wire according to the embodiment. FIG. 10 is a longitudinal cross-sectional view of the terminal-equipped electric wire according to the embodiment. FIG. 11 is a lateral cross-sectional view of the terminal-equipped electric wire according to the embodiment.

FIG. 6 illustrates a cross section taken along line VI-VI of FIG. 5. FIG. 7 illustrates a cross section taken along line VII-VII of FIG. 5. FIG. 10 illustrates a cross section taken along line X-X of FIG. 9. FIG. 11 illustrates a cross section taken along line XI-XI of FIG. 9.

As illustrated in FIG. 1, a crimp terminal 1 according to the present embodiment includes a terminal connecting portion 11, a core wire crimp portion 12, and a covering crimp portion 13. The terminal connecting portion. 11, the core wire crimp portion 12, and the covering crimp portion 13 are arranged in this order in a longitudinal direction of the crimp terminal 1. The crimp terminal 1 is formed from a conductive metal plate (for example, a copper plate or a copper alloy plate) as a base material. The crimp terminal 1 is formed into a predetermined shape by punching or bending the base material. The surface of the crimp terminal 1 may be plated with tin (Sn) or the like.

In the description of the crimp terminal 1 in the present specification, a connection direction with the counterpart terminal, that is, an insertion direction with respect to the counterpart terminal is referred to as a first direction L. The first direction L is the longitudinal direction of the crimp terminal 1. A width direction of the crimp terminal 1 is referred to as a second direction W. The second direction W is orthogonal to the first direction L. In the crimp terminal 1, a direction orthogonal to both the first direction L and the second direction W is referred to as a third direction H. The third direction H is a compression direction by an upper mold 50 when the crimp terminal 1 is crimped. The third direction H is a height direction of the crimp terminal 1.

The terminal connecting portion 11 is a portion electrically connected to a counterpart terminal. The shape of the terminal connecting portion 11 of the present embodiment is a rectangular tube shape. The core wire crimp portion 12 is a portion to be crimped to a core wire 61 of an electric wire 60. The electric wire 60 includes a core wire 61 and an insulating covering 62 covering the core wire 61. Examples of the material of the core wire 61 include copper and aluminum. As illustrated in FIG. 2, the cross-sectional shape of the electric wire 60 of the present embodiment is circular. The outer diameter of the electric wire 60 is referred to as a finished outer diameter D. The finished outer diameter D is the outer diameter of the electric wire 60 before the crimp terminal 1 is crimped to the electric wire 60. The finished outer diameter D of the terminal-equipped electric wire 2 (refer to FIG. 8 or the like) corresponds to an outer diameter of the covering 62 of a portion 60*a* of the electric wire 60 to which the crimp terminal 1 is not crimped.

As illustrated in FIG. 1, in the electric wire 60, the covering 62 at the end is removed to expose the core wire 61 by a predetermined length. The core wire 61 of the present embodiment is a group of a plurality of strands. Alternatively, the core wire 61 may be a single wire such as a coaxial cable. The crimp terminal 1 is crimped to the end portion of the electric wire 60 and thereby electrically connected to the exposed core wire 61.

The shape of the core wire crimp portion 12 before being crimped to the core wire 61 is a U-shape as illustrated in FIG. 1. The core wire crimp portion 12 includes a bottom wall portion 21, a first crimping piece 22, and a second crimping piece 23. The bottom wall portion 21 is a portion to be a bottom wall of the core wire crimp portion 12, and is supported by a lower mold 40 described below. The first crimping piece 22 and the second crimping piece 23 are a pair of conductor crimping pieces to be crimped to the core wire 61. The first crimping piece 22 is a side wall portion extending from one end of the bottom wall portion 21 in the width direction. The second crimping piece 23 is a side wall portion extending from the other end in the width direction of the bottom wall portion 21. The first crimping piece 22 and the second crimping piece 23 extend in a direction intersecting the width direction of the bottom wall portion 21. The first crimping piece 22 and the second crimping piece 23 face each other in the second direction W. As illustrated in FIG. 1, the interval between the first crimping piece 22 and the second crimping piece 23 increases from the bottom wall portion 21 side toward the tip side.

As illustrated in FIG. 1, the covering crimp portion 13 includes a bottom wall portion 31, a first crimping piece 32, and a second crimping piece 33. The shape of the covering crimp portion 13 before being crimped to the covering 62 is a U-shape as illustrated in FIGS. 1 and 3. The bottom wall portion 31 is a portion to be a bottom wall of the covering crimp portion 13. The first crimping piece 32 and the second crimping piece 33 are a pair of covering crimping pieces to be crimped to the covering 62. The first crimping piece 32 is a side wall portion extending from one end of the bottom wall portion 31 in the width direction. The second crimping piece 33 is a side wall portion extending from the other end of the bottom wall portion 31 in the width direction. The first crimping piece 32 and the second crimping piece 33 face each other in the second direction W. The interval between the first crimping piece 32 and the second crimping piece 33 increases from the bottom wall portion 31 side toward the tip side.

The terminal connecting portion 11 and the core wire crimp portion 12 are connected via an intermediate portion 14. The height of the intermediate portion 14 is lower than any of the height of the terminal connecting portion 11 and the height of the core wire crimp portion 12. The core wire crimp portion 12 and the covering crimp portion 13 are connected via an intermediate portion 15. The intermediate portion 15 includes a bottom wall portion 15*a* and a side wall portion 15*b*. The bottom wall portion 15*a* connects the bottom wall portion 21 of the core wire crimp portion 12 with the bottom wall portion 31 of the covering crimp portion 13. The side wall portion 15*b* extends from both ends of the bottom wall portion 15*a* in the width direction. One side wall portion 15*b* connects the first crimping piece 22 of the core wire crimp portion 12 with the first crimping piece 32 of the covering crimp portion 13. The other side wall portion 15*b* connects the second crimping piece 23 of the core wire crimp portion 12 with the second crimping piece 33 of the covering crimp portion 13. The height of the side wall portion 15*b* is lower than any of the heights of the crimping pieces 22 and 23 of the core wire crimp portion 12 and the heights of the crimping pieces 32 and 33 of the covering crimp portion 13.

As illustrated in FIG. 1, the electric wire 60 is mounted on the crimp terminal 1 such that an axial-direction of the electric wire 60 is aligned with the longitudinal direction of the crimp terminal 1. In a state of being mounted on the crimp terminal 1, a tip 61*a* of the core wire 61 is directed to the terminal connecting portion 11. The core wire 61 exposed to the outside from the covering 62 is mounted on the core wire crimp portion 12. At this time, the tip 61*a* of the core wire 61 may protrude from the core wire crimp portion 12 to the terminal connecting portion 11 side. The covering 62 of the electric wire 60 is mounted on the covering crimp portion 3. The electric wire 60 is installed so that a tip 62*a* of the covering 62 is positioned between the core wire crimp portion 12 and the covering crimp portion 13, for example.

The core wire crimp portion 12 and the covering crimp portion 13 are crimped to the electric wire 60 by the lower mold 40 and the upper mold 50 as illustrated in FIG. 3. The lower mold 40 and the upper mold 50 are components of a terminal crimping device 100. The lower mold 40 is a support-side mold that supports the core wire crimp portion 12 and the covering crimp portion 13 from below. A support surface 40*a* of the lower mold 40 supports an outer surfaces of the bottom wall portions 21 and 31 of the crimp terminal 1. The cross-sectional shape of the support surface 40*a* is an arc shape, for example. FIG. 3 illustrates the covering crimp portion 13 supported by the lower mold 40. The first crimping piece 32 and the second crimping piece 33 are in a posture extending diagonally upward from the bottom wall portion 31 in a state where the covering crimp portion 13 is supported by the lower mold 40. Similarly, the lower mold 40 supports the core wire crimp portion 12 from below.

In the covering crimp portion 13 of the present embodiment, the length of the second crimping piece 33 is equal to the length of the first crimping piece 32. Therefore, in a state where the covering crimp portion 13 is mounted on the support surface 40*a*, a tip surface 33*a* of the second crimping piece 33 is positioned at the same height as a tip surface 32*a* of the first crimping piece 32 in the third direction H.

The upper mold 50 is a terminal crimping mold that sandwiches the crimp terminal 1 and the electric wire 60 between the lower mold 40 and oneself and thereby crimps the crimp terminal 1 to the electric wire 60. The upper mold 50 sandwiches the core wire crimp portion 12 and the core wire 61 between the lower mold 40 and oneself and thereby crimps the core wire crimp portion 12 to the core wire 61. In addition, the upper mold 50 sandwiches the covering crimp portion 13 and the covering 62 between the lower mold 40 and oneself and thereby crimps the covering crimp portion 13 to the covering 62. As illustrated in FIG. 3, the upper mold 50 is disposed above the lower mold 40. The upper mold 50 moves relative to the lower mold 40 in the third direction H. The terminal crimping device 100 includes a driving device that moves the upper mold 50 up and down in the third direction H.

The upper mold 50 has a crimping surface 51 that crimps the covering crimp portion 13. The crimping surface 51 includes a first wall surface 52, a second wall surface 53, and a facing surface 54. The first wall surface 52, the second wall surface 53, and the facing surface 54 are continuous with each other and form a groove opening downward. The first wall surface 52 and the second wall surface 53 face each other in the second direction W. The first wall surface 52 includes a flat portion 52*a* and a curved portion 52*b*. The second wall surface 53 includes a flat portion 53*a* and a curved portion 53*b*. The flat portions 52*a* and 53*a* extend in the first direction L and the third direction H, and are orthogonal to the second direction W. The flat portions 52*a* and 53*a* face each other in the second direction W and are parallel to each other.

The curved portions 52*b* and 53*b* extend downward from the flat portions 52*a* and 53*a*, respectively. The curved portions 52*b* and 53*b* face each other in the second direction W, and are gently curved so that the interval between the curved portions increases downward. A boundary 52*c* between the flat portion 52*a* and the curved portion 52*b* is located above a boundary 53*c* between the flat portion 53*a* and the curved portion 53*b*. This gives a sufficient time difference between the timing when the second crimping piece 33 starts to bend and the timing when the first crimping piece 32 starts to bend. Accordingly, in the crimping step, the second crimping piece 33 is wound around the covering 62 before the first crimping piece 32. In other words, the second crimping piece 33 enters between the first crimping piece 32 and the covering 62.

The facing surface 54 connects an upper end of the first wall surface 52 and an upper end of the second wall surface 53. The facing surface 54 faces the support surface 40*a* of the lower mold 40 in the third direction H. The facing surface 54 is a curved surface that is recessed upward. The facing surface 54 includes a central portion 54*a* located at the center in the second direction W, and connecting portions 54*b* and 54*c* located at both ends in the second direction W. The central portion 54*a* and the connecting portions 54*b*, 54*c* are each curved to protrude upward.

The connecting portion 54*b* connects the central portion 54*a* with the flat portion 52*a* of the first wall surface 52. The connecting portion 54*c* connects the central portion 54*a* with the flat portion 53*a* of the second wall surface 53. The curvatures of the connecting portions 54*b* and 54*c* gradually vary from the central portion 54*a* toward the flat portions 52*a* and 53*a*.

The flat portions 52*a* and 53*a* of the present embodiment are configured to enable the first crimping piece 32 and the second crimping piece 33 to be brought into close contact with the covering 62 of the electric wire 60, as described below. More specifically, an interval Wd1 between the flat portion 52*a* of the first wall surface 52 and the flat portion 53*a* of the second wall surface 53 is defined so as to allow the covering 62 to be compressed from both sides in the second direction W by the crimping pieces 32 and 33. The interval Wd1 in the second direction W satisfies the following Formula (1). The interval Wd1 preferably satisfies the following Formula (2). Here, D: the finished outer diameter of the electric wire 60, and t: the plate thickness of the covering crimp portion 13.

$$Wd1 < D + 2 \times t \quad (1)$$

$$Wd1 > D \quad (2)$$

The position of the bottom dead center of the upper mold 50 is defined to enable the first crimping piece 32 and the second crimping piece 33 to be brought into close contact with the covering 62 of the electric wire 60. FIG. 4 illustrates the terminal crimping device 100 in a state where the upper mold 50 is at the bottom dead center. In a case where the upper mold 50 is at the bottom dead center, a distance Ht1 between the support surface 40*a* and the facing surface 54 is defined to allow the covering crimp portion 13 to compress the covering 62 from both sides in the third direction H. Note that the distance Ht1 is a distance in the third direction H from a lowermost portion 40*b* of the support surface 40*a* to an uppermost portion 54*d* of the facing surface 54. In the present embodiment, the lowermost portion 40*b* of the support surface 40*a* corresponds to the center of the support surface 40*a* in the second direction W. The uppermost portion 54*d* of the facing surface 54 corresponds to the center of the facing surface 54 in the second direction W. That is, the lowermost portion 40*b* and the uppermost portion 54*d* are on an identical line in the third direction H.

The distance Ht1 satisfies the following Formula (3). The distance Ht1 preferably satisfies the following Formula (4).

$$Ht1 < D + 3 \times t \quad (3)$$

$$Ht1 > D + t \quad (4)$$

A downward movement of the upper mold 50 to the bottom dead center will allow the crimp terminal 1 to be crimped to the electric wire 60 as illustrated in FIGS. 5 to 7. As illustrated in FIG. 5, the core wire crimp portion 12 is crimped to the core wire 61. The tip 61*a* of the core wire 61 protrudes from the core wire crimp portion 12 toward the terminal connecting portion 11. The covering crimp portion 13 is crimped to the covering 62. An intermediate exposed portion 61*b* of the core wire 61 is exposed between the core wire crimp portion 12 and the covering crimp portion 13. Furthermore, the end of the covering 62 is exposed from the covering crimp portion 1 toward the core wire crimp portion 12 side.

As illustrated in FIG. 6, the core wire crimp portion 12 is crimped to the core wire 61 in a substantially B shape. The cross-sectional shape of each of the first crimping piece 22 and the second crimping piece 23 after crimping is a curved shape protruding toward the side opposite to the bottom wall portion 21 side. More specifically, the first crimping piece 22 has a curved portion 22*b* and a base portion 22*c*. The base portion 22*c* is a portion extending linearly from the bottom wall portion 21 in the third direction H. The curved portion 22*b* is a portion of the first crimping piece 22 on more tip side compared with the base portion 22*c*, and is curved outward.

The second crimping piece 23 includes a curved portion 23*b* and a base portion 23*c*. The base portion 23*c* is a portion extending linearly from the bottom wall portion 21 in the third direction H. The curved portion 23*b* is a portion of the second crimping piece 23 on more tip side compared with the base portion 23*c*, and is curved outward. A portion where an outer surface 22*d* of the first crimping piece 22 and an outer surface 23*d* of the second crimping piece 23 come in contact is formed into a groove 24. The groove 24 extends in the first direction L.

As illustrated in FIG. 7, the covering crimp portion 13 has an annular shape, and is crimped to the covering 62 with the first crimping piece 32 layered over the second crimping piece 33. Each of the cross-sectional shapes of the first crimping piece 32 and the second crimping piece 33 after crimping is a shape protruding outward. More specifically, the first crimping piece 32 has a curved portion 32*b* and a base portion 32*c*. The base portion 32*c* is a portion extending linearly from the bottom wall portion 31 in the third direction H. The curved portion 32*b* is a portion of the first crimping piece 32 on more tip side compared with the base portion 32*c*. The curved portion 32*b* is curved outward. In the curved portion 32*b*, the tip is located on the uppermost side.

The second crimping piece 33 has a curved portion 33*b* and a base portion 33*c*. The base portion 33*c* is a portion extending linearly from the bottom wall portion 31 in the third direction H. The curved portion 33*b* is a portion of the second crimping piece 33 on more tip side compared with the base portion 33*c*, and is curved outward. The tip surface 33*a* of the second crimping piece 33 is located on more toward the first crimping piece 32 side of a center 31*c* of the bottom wall portion 31 in the width direction of the bottom wall portion 31. Furthermore, the tip surface 33*a* of the second crimping piece 33 is directed toward the bottom wall portion 31 side and faces the bottom wall portion 31 in the third direction H. The curved portion 33*b* of the second crimping piece 33 covers an upper portion 62*b* of the covering 62 and is in close contact with the upper portion 62*b*.

The second crimping piece 33 is crimped to the covering 62 such that the tip surface 33*a* is buried in the covering 62, for example. In the crimping step, the first crimping piece 32 is layered over a tip portion 33*e* of the second crimping piece 33 and pushes the tip portion 33*e* toward the covering 62. This results in formation of a recess 62*c* corresponding to a corner 33*g* of the second crimping piece 33, in the covering 62. The corner 33*g* is a portion at which the inner surface of the second crimping piece 33 and the tip surface 33*a* intersect. The tip surface 33*a* faces an outer surface 62*d* of the covering 62, and preferably is in contact with the covering 62.

The first crimping piece 32 is layered over the tip portion 33*e* of the second crimping piece 33. More specifically, the first crimping piece 32 is layered over a portion of the second crimping piece 33 between the tip surface 33*a* and a top 33*f*. The top 33*f* is a portion of the curved portion 33*b*, that is located farthest from the bottom wall portion 31 in the third direction H. That is, the first crimping piece 32 covers substantially half of the curved portion 33*b* on the base portion 32*c* side.

In the terminal-equipped electric wire 2 of the present embodiment, a gap 4 is closed by the resin 3 described below. The gap 4 is a gap surrounded by the tip surface 33*a* of the second crimping piece 33, an inner surface 32*e* of the first crimping piece 32, and the outer surface 62*d* of the covering 62. The gap 4 might have a cross-sectional area large enough to be visually recognized or might be too small to be visually recognized. The gap 4 is a gap that allows infiltration of water, for example. In the terminal-equipped electric wire 2 of the present embodiment, closing the gap 4 with the resin 3 will ensure the anticorrosion performance.

In the covering crimp portion 13 after the crimping, the base portion 32*c* of the first crimping piece 32 may be parallel to the base portion 33*c* of the second crimping piece 33. In the present embodiment, the outer surface of the base portion 32*c* and the outer surface of the base portion 33*c* are parallel to each other and are orthogonal to the second direction W. The base portions 32*c* and 33*c* are respectively formed by the flat portions 52*a* and 53*a* of the upper mold 50.

In the covering crimp portion 13, the bottom wall portion 31, the first crimping piece 32, and the second crimping piece 33 are each in close contact with the covering 62. In other words, the covering crimp portion 13 is in close contact with the outer peripheral surface of the covering 62 over the entire circumference. Furthermore, the covering crimp portion 13 compresses the covering 62 inward in the radial direction over the entire circumference. Accordingly, the covering 62 is compressed in a state of being sandwiched between the covering crimp portion 13 and the core wire 61. As a result, the covering 62 generates a repulsive force repelling toward the covering crimp portion 13. Therefore, generation of a gap between the covering crimp portion 13 and the covering 62 is suppressed.

The covering crimp portion 13 according to the present embodiment is cramped to the covering 62 so as to satisfy the following Formulas (5) and (7). The covering crimp portion 13 is preferably crimped to the covering 62 so as to satisfy the following Formulas (6) and (8). Here, CH: terminal height in the covering crimp portion 13, and CW: terminal width in the covering crimp portion 13. The terminal height CH of the covering crimp portion 13 is, for example, the maximum dimension in the third direction H in the lateral cross section of the covering crimp portion 13. The terminal height CH of the present embodiment is a height from the outer surface of the center 31*c* of the bottom wall portion 31 to the outer surface of the tip of the first crimping piece 32. The terminal width CW of the covering crimp portion 13 is, for example, the maximum dimension in the second direction W in the lateral cross section of the covering crimp portion 13. The terminal width CW of the present embodiment is a distance in the second direction W from the outer surface of the base portion 32*c* to the outer surface of the base portion 33*c*.

$$CH<D+3\times t \quad (5)$$

$$CH>D+t \quad (6)$$

$$CW<D+2\times t \quad (7)$$

$$CW>D \quad (8)$$

When Formulas (5) and (7) are satisfied, the covering crimp portion 13 is crimped to the covering 62 while compressing the covering 62 toward the core wire 61 in each of the second direction W and the third direction H. The covering crimp portion 13 of the present embodiment is crimped so that the terminal width CW and the terminal height CH are substantially equal to each other. However, the relationship between the terminal width CW and the terminal height CH is not limited to the above relationship. For example, the covering crimp portion 13 may be crimped so that the terminal width CW is larger than the terminal height CH, or may be crimped so that the terminal height CH is larger than the terminal width CW.

Furthermore, in the terminal-equipped electric wire 2 of the present embodiment, the shape of the covering crimp portion 13 after crimping is designed so that the gap 4 can be easily closed by the resin 3. Specifically, a height ΔH of the tip portion 33*e* of the second crimping piece 33 satisfies the following Formula (9). Here, the height ΔH is a distance in the third direction H from the top 33*f* to the lower end of the tip surface 33*a*. The gap 4 is located near the top 33*f* in the third direction H, making it easy to apply the resin 3 so as to close the gap 4.

$$t<\Delta H\leq 2\times t \quad (9)$$

After completion of the crimping step of crimping the crimp terminal 1 on the electric wire 60, an application step of applying a resin 3 is executed. FIG. 8 illustrates an application range B1 within which the resin 3 is applied. The application range B1 is a region expanding in the first direction L and the second direction W. The application range B1 is a range including from the tip 61*a* of the core wire 61 to side surfaces 32*d* and 33*d* of the covering crimp portion 13. More specifically, the application range B1 is a region including the tip 61*a* of the core wire 61 including an end surface 61*c*, a bottom portion 14*a* and an end surface 14*b* of the intermediate portion 14, the groove 24 of the core wire crimp portion 12, the intermediate exposed portion 61*b*, an end surface 15*c* of the intermediate portion 15, the side surface 32*d* of the first crimping piece 32, and the side surface 33*d* of the second crimping piece 33. The side surfaces 32*d* and 33*d* are side surfaces on the core wire crimp portion 12 side, and are surfaces facing the core wire crimp portion 12 side.

Figure 12:
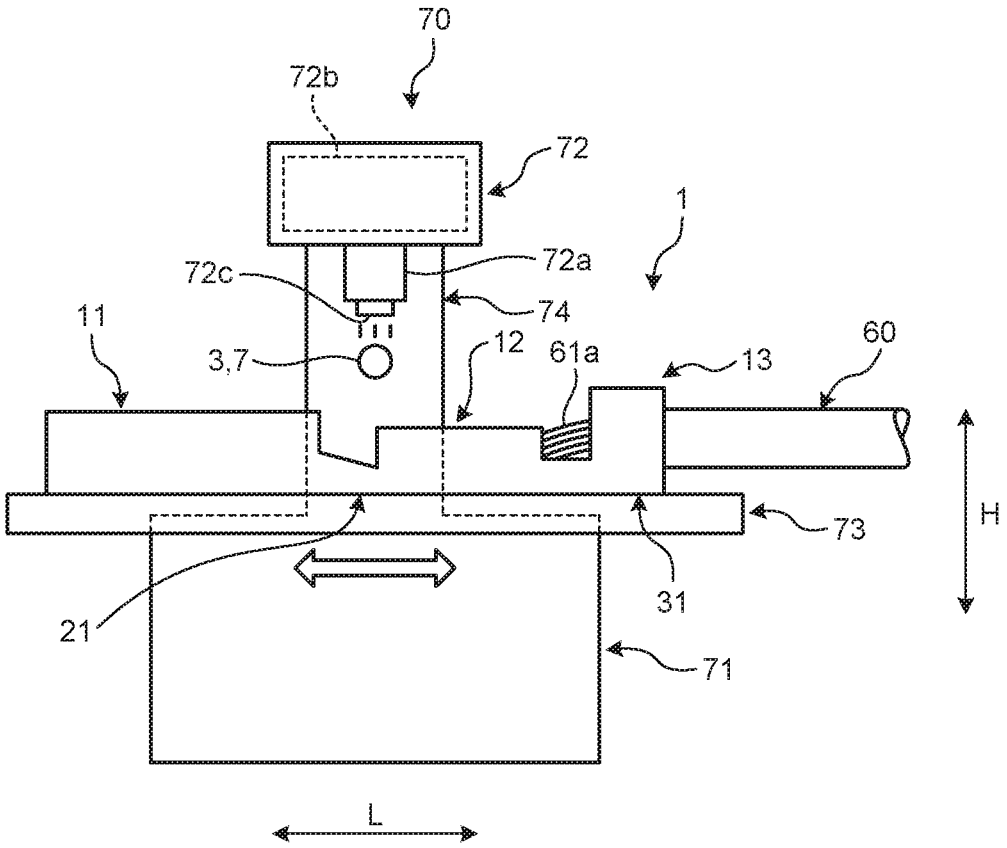
FIG. 12 is a front view of an application device according to an embodiment.

In the application step, the resin 3 is applied by an application device 70 illustrated in FIG. 12, for example. The application device 70 includes a main body 71, an injection unit 72, and a holding unit 73. The injection unit 72 is supported by the main body 71 via an arm unit 74. The injection unit 72 includes a nozzle 72*a* and an injection mechanism 72*b*. The nozzle 72*a* is a cylindrical hollow member. a ejection port 72*c* at the tip of the nozzle 72*a* faces the holding unit 73. The injection mechanism 72*b* is a mechanism for intermittently injecting droplets 7 of the resin 3 from the nozzle 72*a*.

The holding unit 73 is a portion that holds the crimp terminal 1, and is relatively movable with respect to the main body 71. The application device 70 injects the droplets 7 of the resin 3 from the nozzle 72*a* while moving the holding unit 73 so as to apply the resin 3 to the electric wire 60 and the crimp terminal 1. The applied resin 3 is an ultraviolet curable resin, for example. The resin 3 to be used may be a thermosetting resin or a two-component curable resin, for example.

As illustrated in FIGS. 9 and 10, the application device 70 applies the resin 3 to the application range B1. The core wire 61 is shielded from the external space by the applied resin 3. The resin 3 serves as a protective film that covers the electric wire 60 and the crimp terminal 1 integrally and protects the core wire 61. As illustrated in FIG. 11, the resin 3 is applied so as to close the gap 4 from the core wire crimp portion 12 side. That is, the resin 3 is applied so as to close the opening formed by the tip surface 33*a* of the second crimping piece 33, the inner surface 32*e* of the first crimping piece 32, and the outer surface 62*d* of the covering 62.

The resin 3 is applied so as to cover the side surface 32*d* of the first crimping piece 32 and the side surface 33*d* of the second crimping piece 33. The resin 3 is applied so as to cover a range from the outer surface of the covering 62 to the side surface 32*d* of the first crimping piece 32 in the radial direction. An application region of the resin 3 in the radial direction includes at least the tip surface 33*a* of the second crimping piece 33. The resin 3 may be applied so as to cover the entire side surface 32*d* of the first crimping piece 32 and the entire side surface 33*d* of the second crimping piece 33, as illustrated in FIG. 11.

When the application step is completed, a curing step is executed. The curing step is a step of curing the applied resin 3. The ultraviolet curing resin 3 is irradiated with ultraviolet rays in a curing step. The curing step is executed to fix the resin 3 to the core wire 61, the covering 62, and the crimp terminal 1 so as to form a resin film that integrally covers the core wire 61, the covering 62, and the crimp terminal 1. The curing step cures the resin 3 to complete formation of the terminal-equipped electric wire 2. The resin. 3 cures in a state where the gap 4 is shielded from the core wire crimp portion 12 side.

As illustrated in FIG. 11, in the terminal-equipped electric wire 2 of the present embodiment, the tip surface 33*a* of the second crimping piece 33 is located farther, compared with the end surface 15*c* of the intermediate portion 15, from the bottom wall portion 31 in the third direction H. Accordingly, the gap 4 is located above the end surface 15*c*. This configuration makes it possible to allow the resin 3 applied to easily close the gap 4.

Furthermore, as illustrated in FIG. 10, the tip 62*a* of the covering 62 protrudes from the covering crimp portion 13 toward the core wire crimp portion 12. This enables the gap 4 to be easily closed by the resin 3 applied to the outer surface of the covering 62. Furthermore, as illustrated in FIG. 11, the recess 62*c* formed in the covering 62 has a substantially V-shaped cross section. An other words, the shape of the recess 62*c* is a groove shape opening toward the side opposite to the bottom wall portion 31. The applied resin 3 is stored in the recess 62*c*, enabling the gap 4 to be easily closed by the resin 3.

According to the terminal-equipped electric wire 2 of the present embodiment, infiltration of water is suppressed by the covering crimp portion 13 and the resin 3, leading to suppression of a decrease in electrical performance. For example, when water enters the gap 4, the water is blocked by the resin 3 film. The resin 3 regulates the entry of water into the electrical connection between the core wire 61 and the crimp terminal 1, thereby suppressing occurrence of corrosion of the core wire 61 and the crimp terminal 1. In addition, the covering crimp portion 13 is in close contact with the outer peripheral surface of the covering 62, and suppresses the infiltration of water. In other words, the covering 62 functions as a seal in close contact with the covering crimp portion 13.

As a comparative example, a terminal-equipped electric wire in which the resin 3 is applied to the upper surface of the covering crimp portion 13 in the application step will be considered. In the terminal-equipped electric wire of the comparative example, the terminal height CH in the covering crimp portion 13 is increased by an amount corresponding to the height of the applied resin 3, leading to enlargement of the terminal-equipped electric wire. In contrast, the terminal-equipped electric wire 2 of the present embodiment can improve the anticorrosion performance without increasing the terminal height CH. Therefore, it is possible to improve the anticorrosion performance while using the existing combination of the crimp terminal 1 and the housing as is.

As described above, the terminal-equipped electric wire 2 according to the present embodiment includes the electric wire 60, the crimp terminal 1, and the resin 3. The electric wire 60 includes: the core wire 61; and the covering 62 that exposes the end of the core wire 61 and covers the core wire 61. The crimp terminal 1 includes: the core wire crimp portion 12 crimped to the core wire 61; and the covering crimp portion 13 crimped to the covering 62. The resin 3 integrally covers the range from the tip 61*a* of the core wire 61 to the side surfaces 32*d* and 33*d* of the covering crimp portion 13 so as to shield the core wire 61 from the external space.

The covering crimp portion 13 includes the bottom wall portion 31, the first crimping piece 32, and the second crimping piece 33. The first crimping piece 32 extends from one end of the bottom wall portion 31 in the width direction, and the second crimping piece 33 extends from the other end of the bottom wall portion 31 in the width direction. In the covering crimp portion 13, the bottom wall portion 31, the first crimping piece 32, and the second crimping piece 33 are each crimped in close contact with the covering 62. In addition, the covering crimp portion 13 is crimped with the first crimping piece 32 laid over the tip portion 33*e* of the second crimping piece 33.

The resin 3 closes the gap 4 surrounded by the tip surface 33*a* of the second crimping piece 33, the inner surface 32*e* of the first crimping piece 32, and the outer surface 62*d* of the covering 62, from the core wire crimp portion 12 side. According to the terminal-equipped electric wire 2 of the present embodiment, the infiltration of water through the gap 1 is suppressed by the resin 3. In addition, the bottom wall portion 31, the first crimping piece 32, and the second crimping piece 33 are each in close contact with the covering 62, making it possible to suppress infiltration of water into the electrical connection. Therefore, the terminal-equipped electric wire 2 of the present embodiment can improve the anticorrosion performance while suppressing the terminal height CH.

The crimp terminal 1 of the present embodiment includes the intermediate portion 15 that connects the bottom wall portion 31 with the core wire crimp portion 12 in the axial direction of the electric wire 60. The tip surface 33*a* of the second crimping piece 33 is located farther, compared with the end surface 15*c* of the intermediate portion 15, from the bottom wall portion 31 in the height direction of the crimp terminal 1. The position of the tip surface 33*a* makes it easy to close the gap 4 with the applied resin 3.

The terminal-equipped electric wire 2 of the present embodiment satisfies Formulas (5) and (7). Accordingly, it is possible to eliminate a gap between the covering crimp portion 13 and the covering 62, enabling generation of a repulsive force in the covering 62. This makes it possible to suitably suppress the infiltration of the corrosive liquid such as salt water into the electrical connection between the core wire 61 and the crimp terminal 1.

$$CH<D+3\times t \tag{5}$$

$$CW<D+2\times t \tag{1}$$

The tip surface 33*a* of the second crimping piece 33 of the present embodiment is located on more toward the first crimping piece 32 side of the center 31*c* of the bottom wall portion 31 in the width direction of the bottom wall portion 31. The terminal-equipped electric wire 2 satisfies Formula (9) when the height from the tip surface 33*a* in the height direction of the crimp terminal 1 to the top 33*f* of the second crimping piece 33 is ΔH. Accordingly, the position of the gap 4 is a position that is easily closed by the applied resin 3.

$$t<\Delta H\leq 2\times t \tag{9}$$

Modification of Embodiment

A modification of an embodiment will be described. The crimping shape of the covering crimp portion 13 is not limited to the shape exemplified in the above embodiment. For example, the range in which the first crimping piece 32 and the second crimping piece 33 are laid with each other is appropriately determined.

The application range B1 is not limited to the range exemplified in the above embodiment. The application range B1 is appropriately determined so that the resin 3 integrally covers a range from the tip 61*a* of the core wire 61 to the side surfaces 32*d* and 33*d* of the covering crimp portion 13.

The contents disclosed in the above embodiments and modification examples can be executed in appropriate combination with each other.

In the terminal-equipped electric wire according to the present embodiment, a covering crimp portion has a bottom wall portion, a first crimping piece, and a second crimping piece, each of which being close contact with the covering, and the covering crimp portion is crimped to the covering with the first crimping piece laid over a tip portion of the second crimping piece. Accordingly, the resin closes a gap surrounded by the tip surface of the second crimping piece, an inner surface of the first crimping piece, and an outer surface of the covering, from the side of the core wire crimp portion. It is possible to regulate infiltration of water through a covering crimp portion without applying resin to the upper surface of the covering crimp portion. Therefore, there is an effect of improving the anticorrosion performance while suppressing the terminal height.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A terminal-equipped electric wire comprising:

an electric wire having a core wire and a covering that exposes an end portion of the core wire and covers the core wire;

a crimp terminal having a core wire crimp portion crimped to the core wire, and a covering crimp portion crimped to the covering; and a resin that integrally covers a range from a tip of the core wire to a side surface of the covering crimp portion and that shields the core wire from an external space, wherein the covering crimp portion includes a bottom wall portion, a first crimping piece extending from one end of the bottom wall portion in a width direction, and a second crimping piece extending from another end of the bottom wall portion in the width direction, the covering crimp portion has a configuration in which each of the bottom wall portion, the first crimping piece, and the second crimping piece is in close contact with the covering, and the covering crimp portion is crimped to the covering with the first crimping piece laid over a tip portion of the second crimping piece, the resin closes a gap surrounded by a tip surface of the second crimping piece, an inner surface of the first crimping piece, and an outer surface of the covering, from the core wire crimp portion side, and a tip surface of the first crimping piece is spaced away from the gap.

2. The terminal-equipped electric wire according to claim 1, wherein the crimp terminal includes an intermediate portion that connects the bottom wall portion with the core wire crimp portion in an axial direction of the electric wire, and the tip surface of the second crimping piece is located farther from the bottom wall portion compared to an end surface of the intermediate portion in a height direction of the crimp terminal.

3. The terminal-equipped electric wire according to claim 1, wherein the following Formulas (1) and (2) are satisfied when a terminal height in the covering crimp portion is CH, a terminal width in the covering crimp portion is CW, a finished outer diameter of the electric wire is D, and a plate thickness of the covering crimp portion is t.

$$CH<D+3\times t \quad (1)$$

$$CW<D+2\times t \quad (2)$$

4. The terminal-equipped electric wire according to claim 2, wherein the following Formulas (1) and (2) are satisfied when a terminal height in the covering crimp portion is CH, a terminal width in the covering crimp portion is CW, a finished outer diameter of the electric wire is D, and a plate thickness of the covering crimp portion is t.

$$CH<D+3\times t \quad (1)$$

$$CW<D+2\times t \quad (2)$$

5. The terminal-equipped electric wire according to claim 3, wherein the tip surface of the second crimping piece is located on the side more toward the first crimping piece with respect to a center of the bottom wall portion in the width direction of the bottom wall portion, and the following Formula (3) is satisfied when the height from the tip surface of the second crimping piece to a top of the second crimping piece in the height direction of the crimp terminal is ΔH.

$$\Delta H<2\times t \quad (3)$$

6. The terminal-equipped electric wire according to claim 4, wherein the tip surface of the second crimping piece is located on the side more toward the first crimping piece with respect to a center of the bottom wall portion in the width direction of the bottom wall portion, and the following Formula (3) is satisfied when the height from the tip surface of the second crimping piece to a top of the second crimping piece in the height direction of the crimp terminal is ΔH.

$$\Delta H<2\times t \quad (3)$$

* * * * *